US007448625B2

(12) United States Patent
Förch et al.

(10) Patent No.: US 7,448,625 B2
(45) Date of Patent: Nov. 11, 2008

(54) APPARATUS FOR CONVEYING A SHEET THROUGH A PRINTING MACHINE WITH RADIALLY MOVING SUCTION GRIPPERS

(75) Inventors: Peter Förch, Neustadt (DE); Daniel Gronych, Karlsruhe (DE); Markus Möhringer, Weinheim (DE); Paul Nicola, Heidelberg (DE); Marius Stelter, Heidelberg (DE); Ralf Wadlinger, Hockenheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 222 days.

(21) Appl. No.: 11/214,568

(22) Filed: Aug. 30, 2005

(65) Prior Publication Data

US 2006/0042486 A1 Mar. 2, 2006

(30) Foreign Application Priority Data

Aug. 30, 2004 (DE) ..... 10 2004 042 257

(51) Int. Cl.
*B65H 5/02* (2006.01)

(52) U.S. Cl. ..... 271/277; 271/69; 271/82; 271/275; 271/314; 101/230; 101/232; 101/409

(58) Field of Classification Search ..... 271/69, 271/82, 275, 277, 314; 101/230–232, 408, 101/409

See application file for complete search history.

(56) References Cited

U.S. PATENT DOCUMENTS 1,668,999 A * 5/1928 Priester ..... 101/142
1,895,080 A * 1/1933 MacArthur ..... 101/152
2,394,026 A * 2/1946 Tyler ..... 101/276
2,629,323 A * 2/1953 Baumgardner et al. ..... 101/232
2,660,113 A * 11/1953 Gullixson et al. ..... 101/144
2,757,610 A * 8/1956 Gegenheimer et al. ..... 271/82
3,841,625 A * 10/1974 Carricato ..... 271/182
4,127,265 A * 11/1978 Wirz et al. ..... 271/260
4,697,512 A * 10/1987 Simeth ..... 101/142
4,771,691 A * 9/1988 Sakurai et al. ..... 101/175
4,852,488 A * 8/1989 Abendroth et al. ..... 101/246
4,930,414 A * 6/1990 Wirz ..... 101/183

(Continued)

FOREIGN PATENT DOCUMENTS

DE 3445886 C2 6/1986

(Continued)

*Primary Examiner*—Patrick Mackey
*Assistant Examiner*—Gerald W McClain
(74) *Attorney, Agent, or Firm*—Laurence A. Greenberg; Werner H. Stemer; Ralph E. Locher

(57) ABSTRACT

Sheets are conveyed through a printing machine with improved reliability of the suction grippers. The apparatus for conveying a sheet through a printing machine has a cylinder with grippers in a channel for holding the sheet at its leading edge, circulating grippers for holding and for transferring the sheet from the cylinder at its leading edge, and circulating, radially positionable suction grippers for holding the sheet at its trailing edge. An actuating apparatus opens and closes the grippers and controls vacuum for the suction grippers. A drive for the cylinder and circulating grippers and suction grippers. A control device switches on and off the sheet feed to the cylinder. The suction grippers can be moved in the radial direction into a rest position when the sheet feed is switched off.

4 Claims, 8 Drawing Sheets

U.S. PATENT DOCUMENTS

| | | | | |
|---|---|---|---|---|
| 5,402,723 | A * | 4/1995 | Friedrichs et al. | 101/415.1 |
| 5,927,198 | A * | 7/1999 | Tada | 101/232 |
| 6,401,610 | B1 * | 6/2002 | Becker et al. | 101/232 |
| 6,499,395 | B2 * | 12/2002 | Aoyama et al. | 101/142 |
| 6,578,846 | B2 * | 6/2003 | Maul et al. | 271/277 |
| 6,739,252 | B2 * | 5/2004 | Stephan et al. | 101/230 |
| 6,851,361 | B2 * | 2/2005 | Gorbing et al. | 101/230 |
| 7,234,395 | B2 * | 6/2007 | Forch et al. | 101/232 |
| 2002/0135123 | A1 * | 9/2002 | Maul et al. | 271/277 |
| 2003/0196563 | A1 * | 10/2003 | Gorbing et al. | 101/230 |
| 2005/0087924 | A1 * | 4/2005 | Forch et al. | 271/277 |
| 2005/0126411 | A1 * | 6/2005 | Forch et al. | 101/408 |
| 2005/0188869 | A1 * | 9/2005 | Forch et al. | 101/409 |

FOREIGN PATENT DOCUMENTS

| | | | |
|---|---|---|---|
| DE | 3641439 | A1 | 10/1987 |
| DE | 43 15 528 | A1 | 11/1994 |
| DE | 43 15 548 | A1 | 11/1994 |
| DE | 100 14 417 | A1 | 9/2001 |
| DE | 102 53 788 | A1 | 6/2003 |

* cited by examiner

APPARATUS FOR CONVEYING A SHEET THROUGH A PRINTING MACHINE WITH RADIALLY MOVING SUCTION GRIPPERS

BACKGROUND OF THE INVENTION

FIELD OF THE INVENTION

The invention relates to an apparatus for conveying a sheet through a printing machine. The machine has a cylinder with grippers arranged in a channel for holding the sheet at its leading edge, circulating grippers for holding and for transferring the sheet from the cylinder at its leading edge, and circulating, radially positionable suction grippers for holding the sheet at its trailing edge. There is provided an actuating apparatus for opening and closing the grippers and for controlling vacuum for the suction grippers, a drive for the cylinder and circulating grippers and suction grippers, and a control device for switching on and off the sheet feed to the cylinder.

Commonly assigned U.S. Pat. No. 6,578,846 B2 and German published patent application DE 100 14 417 A1 describe an apparatus for transporting a sheet for a rotary press wherein a sheet is transferred from a cylinder to a chain gripper system. In the chain gripper system, the sheet is held by grippers at the leading edge and at the trailing edge. The trailing edge grippers pick up the sheet in the exit pocket between supporting surfaces circulating with the chain wheels and the cylinder circumferential surface. Until the transfer by the trailing edge grippers, the sheet is held by means of suction grippers, which likewise circulate with the chain wheels. The suction grippers, which are located outside the smallest format width of the sheets, can be adjusted in the direction of the axis of rotation of the suction grippers, so the adjustment of the elements containing the supporting surfaces is possible in the direction parallel to the axis of rotation, in order to be able to set the sheet support on print-free margins of the sheets. The suction grippers located in the format width of the sheets remain permanently in one radial working position. Without any sheet feed, the suction grippers come into contact with the abrasively acting cylinder circumferential surface, so that it is possible for high wear of the suction grippers containing elastomers to occur.

SUMMARY OF THE INVENTION

It is accordingly an object of the invention to provide a device for transporting a sheet through a printing machine which overcomes the above-mentioned disadvantages of the heretofore-known devices and methods of this general type and which provides for an apparatus for conveying a sheet through a printing machine which improves the reliability of the suction grippers.

With the foregoing and other objects in view there is provided, in accordance with the invention, an apparatus for conveying a sheet through a printing machine, comprising:

- a cylinder formed with a channel and grippers disposed in the channel for holding the sheet at a leading edge thereof;
- circulating leading-edge grippers for holding and for transferring the sheet from the cylinder at the leading edge, and circulating, radially positionable, trailing edge suction grippers for holding the sheet at a trailing edge thereof;
- an actuating apparatus for opening and closing the grippers and for controlling a vacuum for the suction grippers;

- a drive for the cylinder and the circulating grippers and suction grippers; and
- a control device for selectively switching on and off a sheet feed to the cylinder;
- wherein the suction grippers are mounted so as to be movable in a radial direction into a rest position when the sheet feed is switched off.

In other words, circulating suction grippers are moved radially inward into a rest position, or position of respite, when the sheet feed is switched off. As soon as a last sheet has been conveyed, the suction grippers are brought out of contact with the surface of the cylinder conveying the sheet. In all the suckers that are out of contact with the surface, the vacuum is switched off. Suction grippers which are outside the format are permanently set in such a way that they have no contact with the surface. The process of switching off grippers which are outside the format is carried out automatically during the normal format setting of the cylinders of the printing machine that convey the sheets.

In accordance with an added feature of the invention, when the sheet feed is switched on, the suction grippers are moveable in the radial direction into a rest position in dependence on a sheet width of the sheet. That is, only those suction grippers that are used in the given print job are driven into operational status, and the other grippers are placed at rest.

In accordance with another feature of the invention, there is provided:

- a chain conveyor with endless chains having fixed thereto the leading-edge grippers and the trailing-edge grippers;
- rotating chain wheels carrying the endless chains;
- coaxially circulating supporting elements for the sheet disposed between the chain wheels assigned to the cylinder, the supporting elements being in rolling contact with a peripheral surface of the cylinder and being movably mounted in a direction of an axis of rotation in dependence on a sheet transverse format; and
- wherein the suction grippers are movably disposed in the radial direction into the rest position as a result of an actuation of positioning elements for the axial displacement of the supporting elements.

In accordance with again another feature of the invention, at least one valve spool is connected to the supporting elements via a pull cable, for switching off respective the suction grippers disposed laterally outside the given sheet width.

In accordance with a further feature of the invention, a suction gripper includes a valve nozzle that rests against a sealing surface in the rest position of the suction gripper, to thereby suppress a vacuum feed to the suction gripper. In a preferred embodiment of the invention, there is provided a bellows that carries the vacuum.

In accordance with a concomitant feature of the invention, a cam shaft and plungers are connected to the suction grippers for moving the suction grippers.

Other features which are considered as characteristic for the invention are set forth in the appended claims.

Although the invention is illustrated and described herein as embodied in an apparatus for conveying a sheet through a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
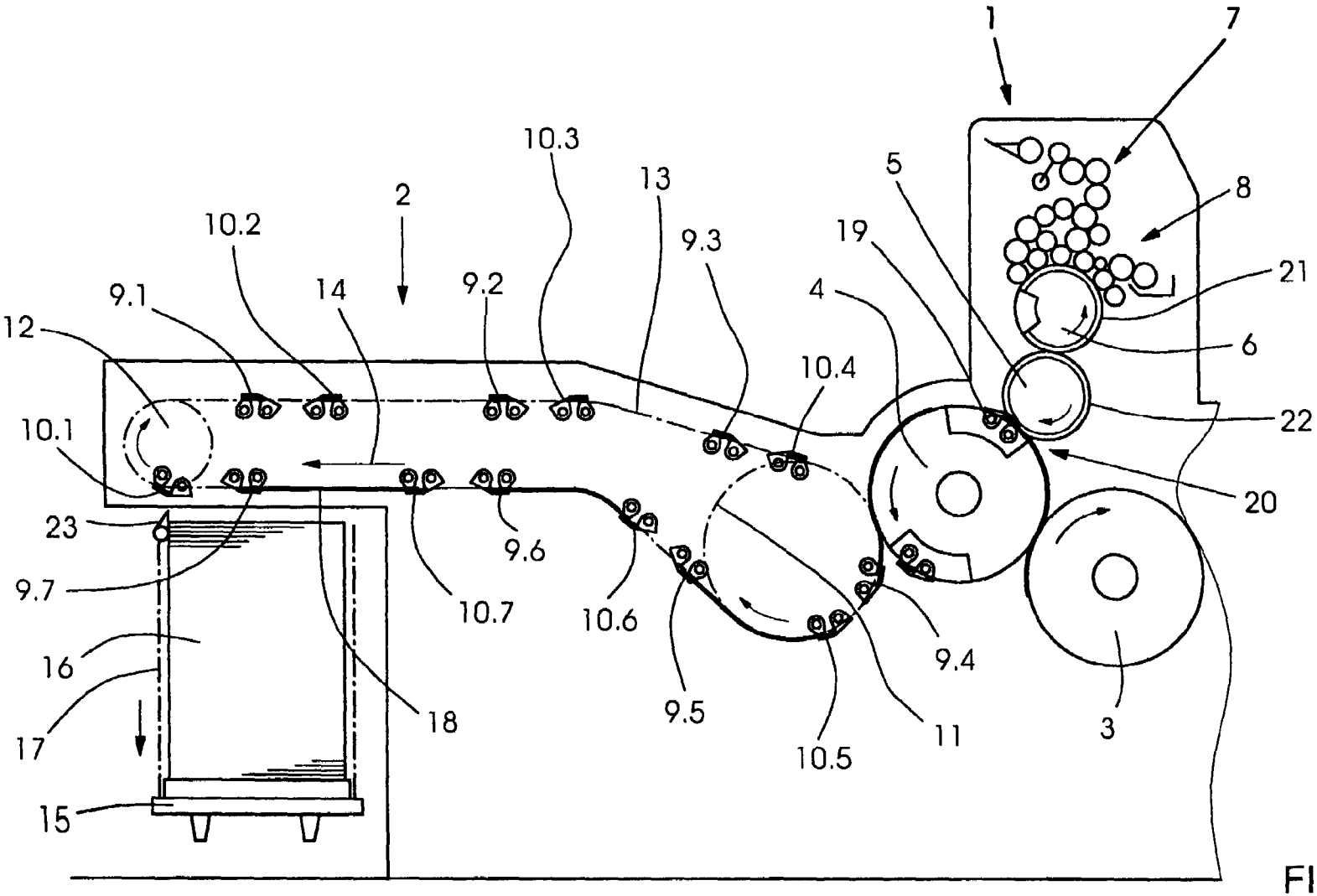
FIG. 1 shows a schematic drawing of a delivery of a press having a chain gripper system.

Referring now to the figures of the drawing in detail and first, particularly, to FIG. 1 thereof, there is shown a last printing unit 1 of a sheet-fed press having a delivery 2 disposed downstream in a transport direction.

The printing unit 1 contains a sheet transport drum 3, an impression cylinder 4, a transfer cylinder 5 and a plate cylinder 6. The plate cylinder 6 is assigned rolls of an inking unit 7 and of a dampening unit 8.

The delivery 2 comprises a chain gripper system having a large number of leading edge grippers 9.1 to 9.7 and trailing edge rippers 10.1 to 10.7, which are fixed to gripper bars. The ripper bars are connected to endless chains, which travel round chain wheels 11, 12 and are guided in chain tracks 13. In the conveying direction 14, at the end of the lower runs of the chain tracks 13, there is a stacking table 15, and a stack 16 supported thereon. The stacking table 15 can be lowered by a chain mechanism 17 in accordance with the progress of production.

Sheets 18 are conveyed from a preceding printing unit by way of the sheet transport drum 3 to the impression cylinder 4. On the impression cylinder 4, the sheets 18 are held in grippers 19 and are guided through a printing nip or press nip 20 between the transfer cylinder 5 and the impression cylinder 4. By using the dampening unit 8 and the inking unit 7, a printing form 21 clamped on the plate cylinder 6 is inked in accordance with an image. The transfer cylinder 5 has a resilient cover 22, with which the printing ink is transferred to the sheet 18 in the press nip 21. In the delivery 2, the sheets 18 are picked up at the leading edge by the leading edge grippers 9, the trailing edge of the sheets 18 being held by the trailing edge grippers 10. Shortly before reaching the stack 16, the grippers 9, 10 are opened, so that the sheet 18 is allowed to fall onto the stack 16. A leading edge stop 23 or front lay limits the movement in the conveying direction 14 of the sheet 18 as it is allowed to fall.

Figure 2:
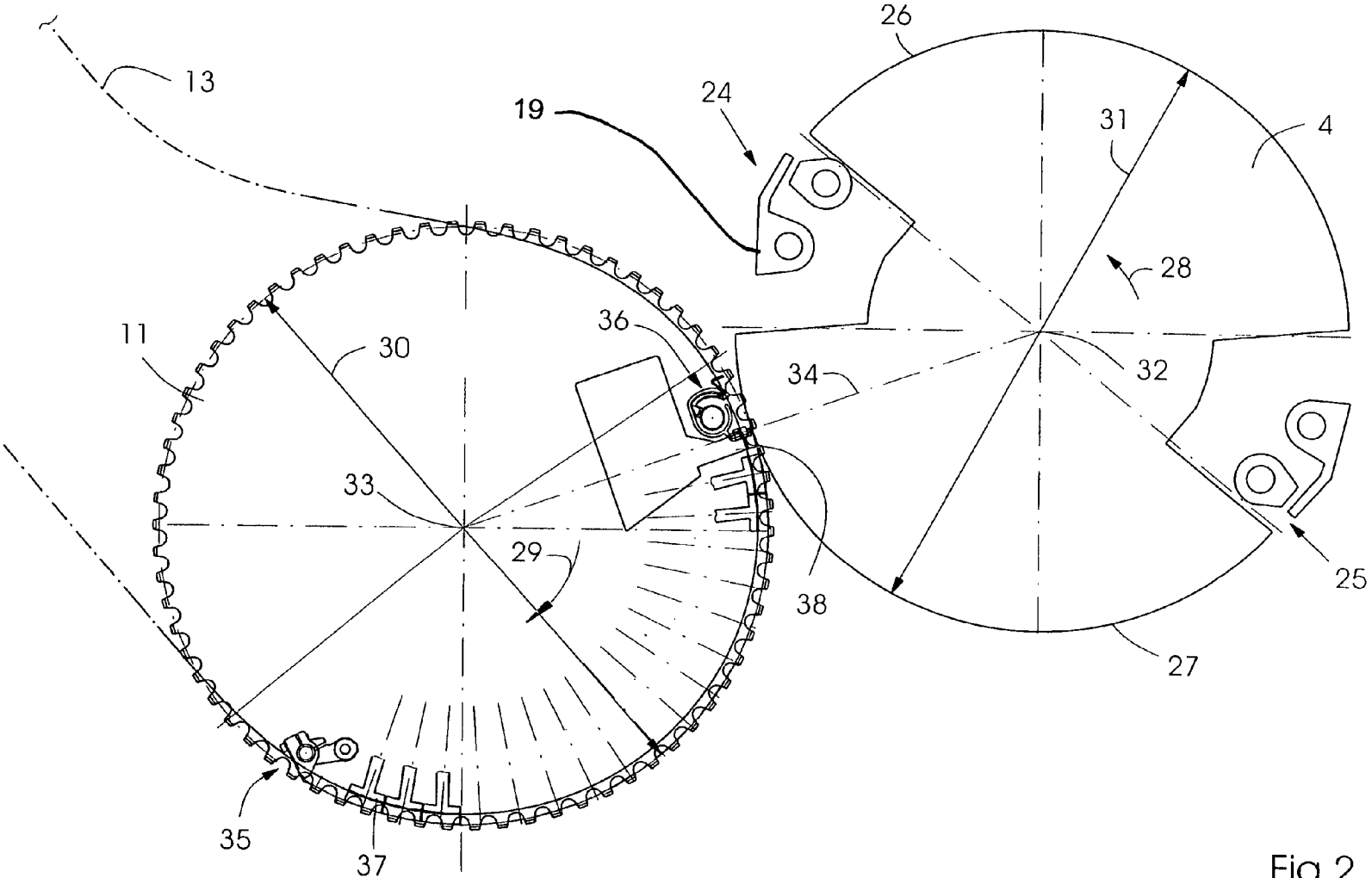
FIG. 2 shows a drawing relating to the sheet transfer between an impression cylinder and the chain gripper system.

FIG. 2 illustrates, in more detail, the elements for conveying the sheet 18 from the impression cylinder 4 onto the leading edge grippers 9 and the trailing edge grippers 10. The impression cylinder 4 is a double-size cylinder formed with two channels 24, 25, wherein the grippers 19 are disposed on gripper bars. The gripper bars reach over the width of a sheet 18, which is held at its leading edge in the grippers 19. The impression cylinder 4 has two circumferential surface segments 26, 27, on which in each case a sheet 18 rests while it is being transported. The length of the circumferential surface segments 26, 27 in the circumferential direction corresponds to the maximum length of a sheet 18 to be conveyed. The impression cylinder 4 and the chain wheels 11 are driven synchronously in the directions of the arrows 28, 29. The pitch circle diameter 30 of the chain wheels 11 and the diameter 31 of the impression cylinder 4 are approximately equal. A connecting line between the axes 32, 33 of the impression cylinder 4 and of the chain wheels 11 forms a transfer center line 34. In the direction at right angles to the plane of the drawing there runs an intersection region between the circular path of the circumferential surfaces 26, 27 and a cylinder to which the pitch circles of the chain wheels 11 belong. The intersection region and the transfer center line 34 are perpendicular to each other. The leading edge grippers 9 and the trailing edge grippers 10 are all arranged at the format width of the gripper bars 35, 36, which are fixed to separate, synchronously circulating chains. The distance between leading edge grippers 9 and trailing edge grippers 10 can be adjusted to the sheet length by shifting the phase of the chains. Between a leading edge gripper bar 35 and the trailing edge gripper bar 36, on the axis 33 there are arranged supporting elements 37 for a sheet 18, which circulate with the chain wheels 11. The supporting elements 37 carry the sheet 18 at the print-free margins. For the purpose of adjustments to the sheet width, the supporting elements 37 can be displaced on the axis 33. The number of supporting elements 37 in the circumferential direction can be varied in accordance with the sheet length. Furthermore, suction grippers which are arranged on a suction gripper bar 38 circulate with the supporting elements 37. In relation to the rotational position, the suction gripper bar 38 is assigned around the axis 33 of the trailing edge gripper bar 36. The suction grippers pick up the sheet 18 at the trailing edge.

The leading edge gripper bar 35 dips into the channel 25 of the impression cylinder 4 as it passes the transfer center line 34. Because of the channel 24/25, there is at this point no risk of collision between the leading edge grippers 9 and the impression cylinder 4. On the other hand, precautions have to be taken for the trailing edge grippers 10 that the trailing edge grippers 10 can pass the circumferential surfaces 26, 27 without contact. For this purpose, before they reach the transfer center line 34, the trailing edge grippers 10 are opened in good time to such an extent that the trailing edge gripper bars 36 can pass without collision.

Figure 3:
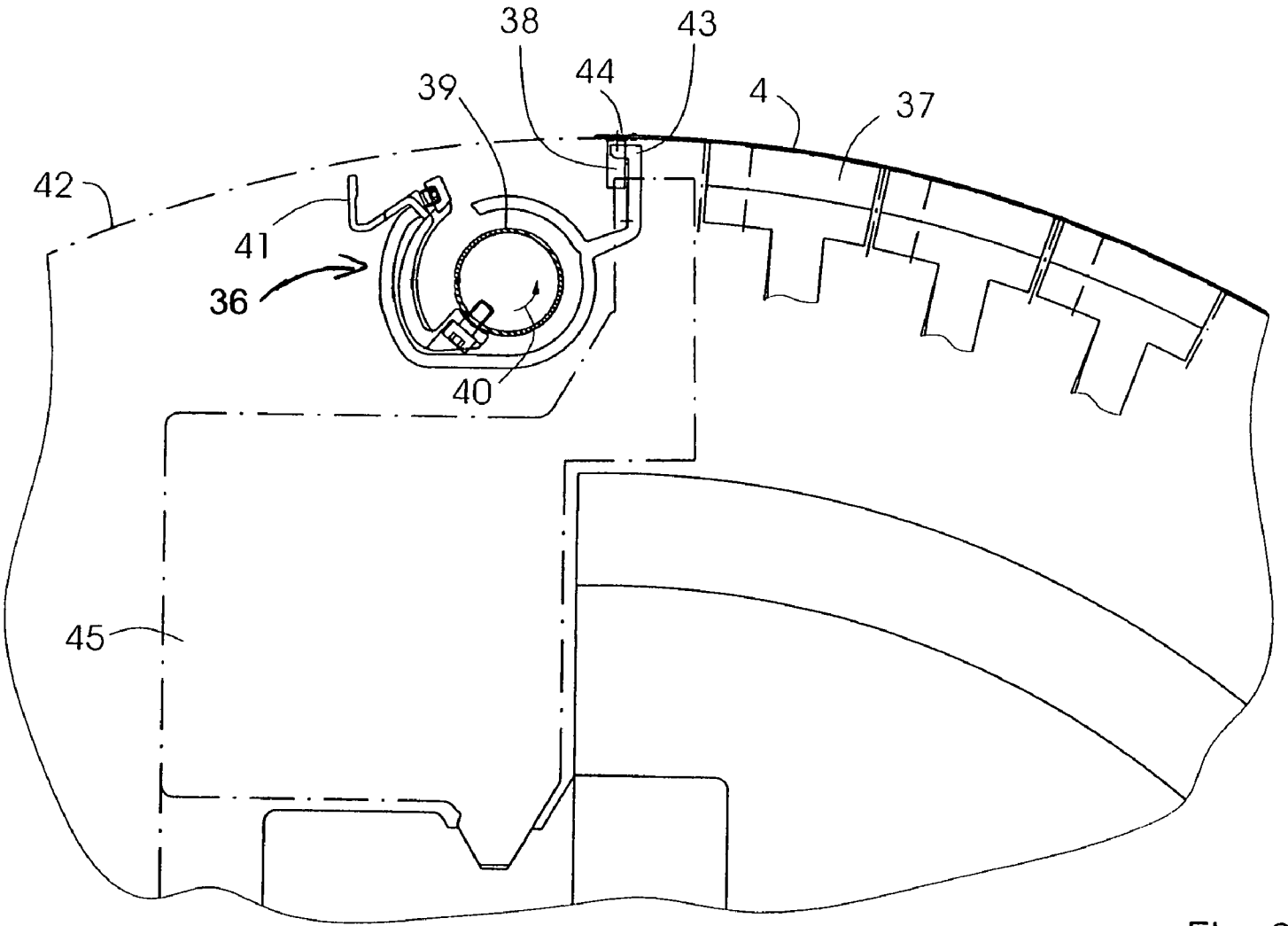
FIG. 3 shows an enlarged view from FIG. 2 with a representation of an overall space for structural elements for holding and operating a suction gripper.

FIG. 3 shows the chain wheels 11 in a rotational position before the transfer center line 34. As a result of rotation of a gripper shaft 39 in the direction 40, the gripper fingers 41 are pivoted back to such an extent that they lie securely under a path 42 described by the supporting surface of the supporting elements 37. The gripper pad 43 is likewise lower in the radial direction than the path 42. In the circumferential direction, the supporting elements 37 reach as far as a suction gripper bar 38, so that a sheet 18 is still held by the supporting surface of the suckers 44 if the suction grippers 38 are just touching the sheet 18.

The overall space 45 assumed by the structural elements for holding and operating the suction grippers 44 is illustrated in dash-dotted form. The fact that the supporting elements 37 reach as far as the suction gripper bar 38 in the circumferential direction means that the overall space 45 is restricted.

Figure 4:
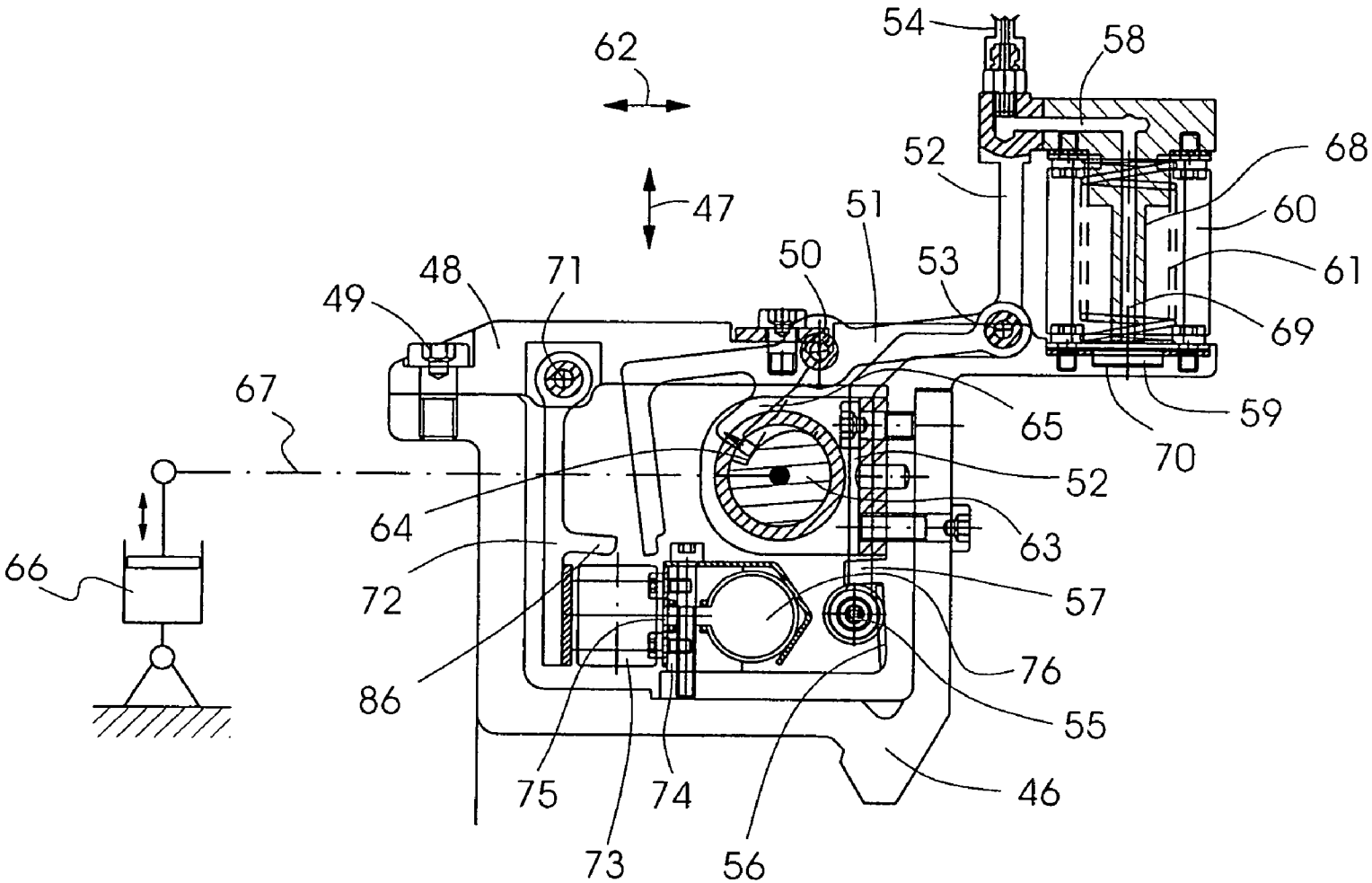
FIG. 4 shows functional elements for setting suckers on and off.
Figure 5:
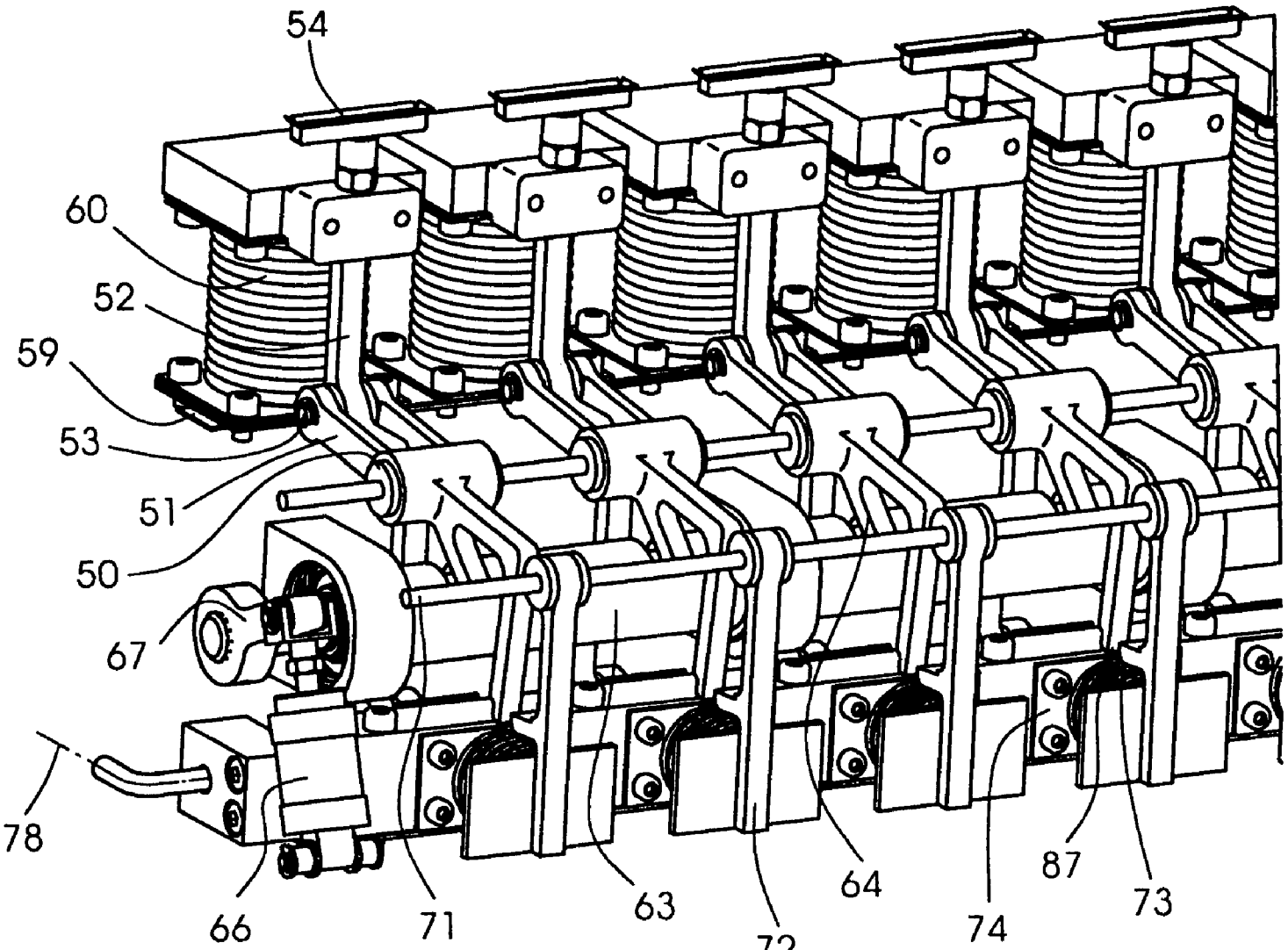
FIG. 5 shows a three-dimensional representation of functional elements according to FIG. 4.

With reference to FIGS. 4 and 5, the following elements are contained in the overall space 45: A rectangular, hollow crossmember 46 circulating about the axis 33 with the chain wheel 11 is covered by a holder 48, as seen in the radial direction 47. The holder 48 is fixed to the crossmember 46 by screws 49. In the three-dimensional illustration according to FIG. 5, the crossmember 46, the holder 48 and the screws 49 have been masked out. On the holder 48, angled-over levers 51 are mounted in pins 50 such that they can be pivoted. The pivot axes of the levers 51 are parallel to the axis 33. In each case at an end of the levers 51, an angled-over sucker rod 52 is mounted in pins 53 such that it can be pivoted. The pivot axis of the sucker rod 52 is parallel to the axis 33. The sucker rod 52 carries an elongated sucker 54. The suckers 54 are aligned on a straight line which lies parallel to the axis 33. In each case at the other end of the sucker rods 52 there is fixed a supporting roller 55, whose axis of rotation is parallel to the axis 33 and which bears on an inner surface 56 of the crossmember 46. The movement of the supporting rollers 55 and therefore the movement of the sucker rods 52 and the suckers 54 in the radial direction 47 is limited by stops 57 in the interior of the crossmember 46. The suckers 54 are connected via vacuum holes 58 to a common vacuum channel 59. For each sucker 54, a bellows 60 and a compression spring 61 are provided. The bellows 60 encloses vacuum openings to the vacuum channel 59 for carrying a vacuum.

The guidance of the reciprocating movement of the suckers 54 is in each case ensured via the sucker rod 52, since the sucker rod 52 is attached in an articulated manner to the lever 51. The fact that the sucker rod 52 is supported on the inner surface 56 by the supporting roller 55 means that tilting of the rod 52 and therefore a movement in the circumferential direction 62 is prevented. In FIG. 4, the suckers 54 are illustrated in the spring-extended state. As a result of the suckers 54 running against the surface of a sheet 18, which is supported on a circumferential surface of segments 26, 27 of the impression cylinder 4, the suckers 54 spring in in the radial direction 47, counter to the force of the bellows 60 and of the compression springs 61. As they spring in, the suckers 54 are displaced by a small amount in the circumferential direction 62, since they also have one degree of freedom in the circumferential direction 62 as a result of the guide mechanism and the compression springs 61.

Figure 6:
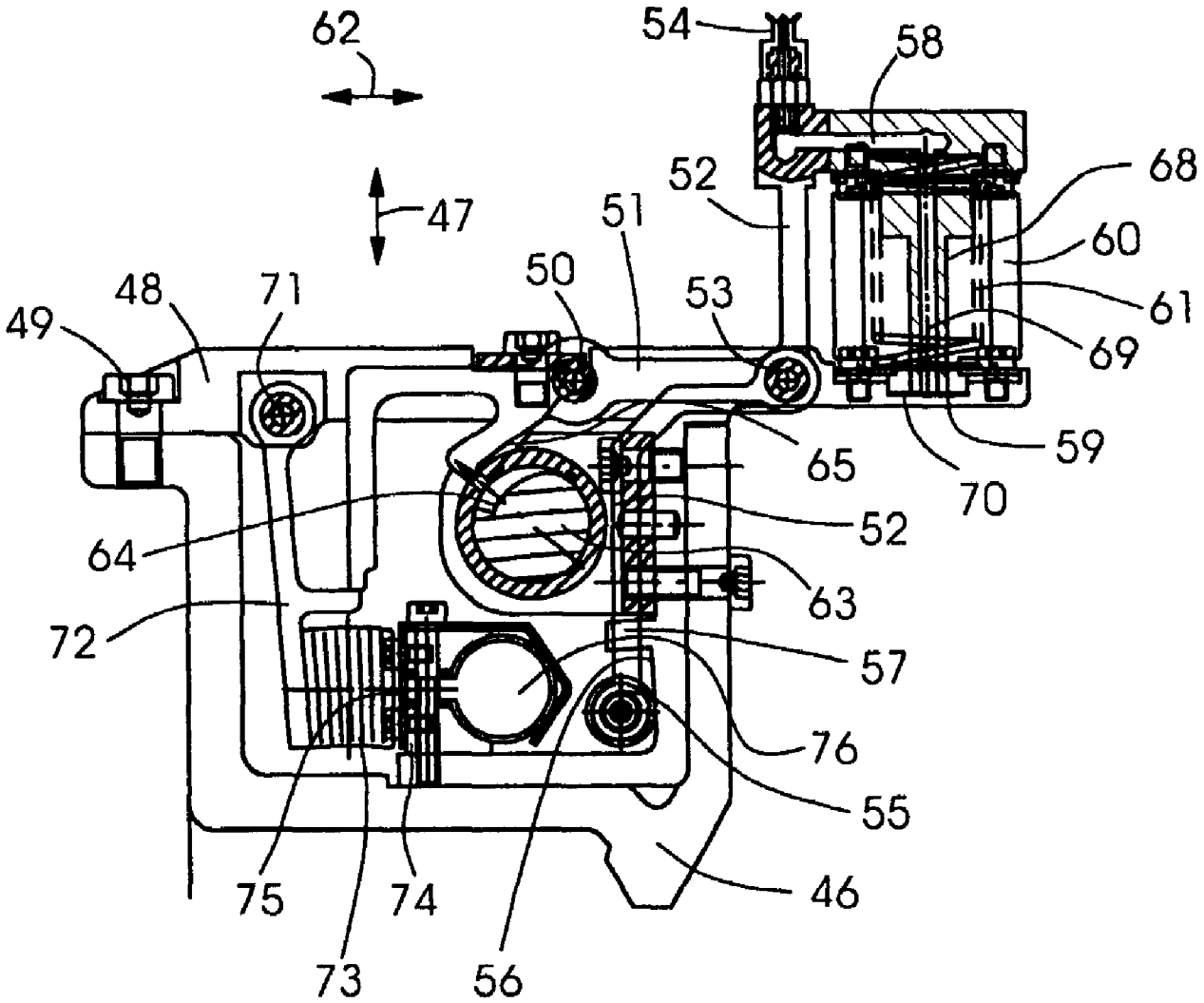
FIG. 6 shows suckers in the rest position

FIGS. 4 and 6, the suckers 54 are respectively illustrated in a position during printing and with the sheet feed switched off. The bellows 60 permit the supply of the vacuum to the movable suckers 54. By means of the bellows 60, the vacuum is sealed off with respect to the surroundings. The bellows 60 remain dimensionally stable when vacuum is applied and withstand the movement cycles permanently. In order to move the suckers 54 out of the position during printing into a rest position or position of respite when the sheet feed is switched off, a cam shaft 63 is provided whose switching cams 64 interact with hammers or plungers 65. The hammers 65 are formed as one-armed levers on the lever 51. In the event of rotation of the cam shaft 63 by a pneumatic cylinder 66 and a lever 67, the hammers 65 slide on the switching cams 64. Via the guide mechanism, the suckers 54 execute a radial reciprocating movement in order to reach the rest position. In the interior of the bellows 60 there are in each case valve nozzles 68 with a vacuum hole 69. In the rest position, the end of the valve nozzles 66 is pressed in a sealing manner against the base 70 of a vacuum channel 59, so that the vacuum feed to the respective sucker 54 is switched off.

Suckers 54 which are outside the format must remain in the rest position both during printing and when the sheet feed is switched off. For the purpose of permanent setting of suckers 54 that are outside the format to the rest position, blocking levers 72 which project into the hollow crossmember 46 are mounted on the holder 48 on an axis 71. In each case at the lower end of a blocking lever 72, one side of a bellows 73 is fixed in a sealing manner. The other side of the bellows 73 is closed by a plate 74. The plates 74 have an air passage opening 75, which is connected to the interior of a pipe 76. In the pipe 76 there are valve spools 77 which are symmetrical with respect to the center 2 of a sheet and are in each case connected to a pull cable 78. Via the pull cables 78, the synchronous and symmetrical adjustment of the valve spools 77 is coupled to the axial adjustment of the supporting elements 37 to the format width of the sheets 18.

Figure 7:
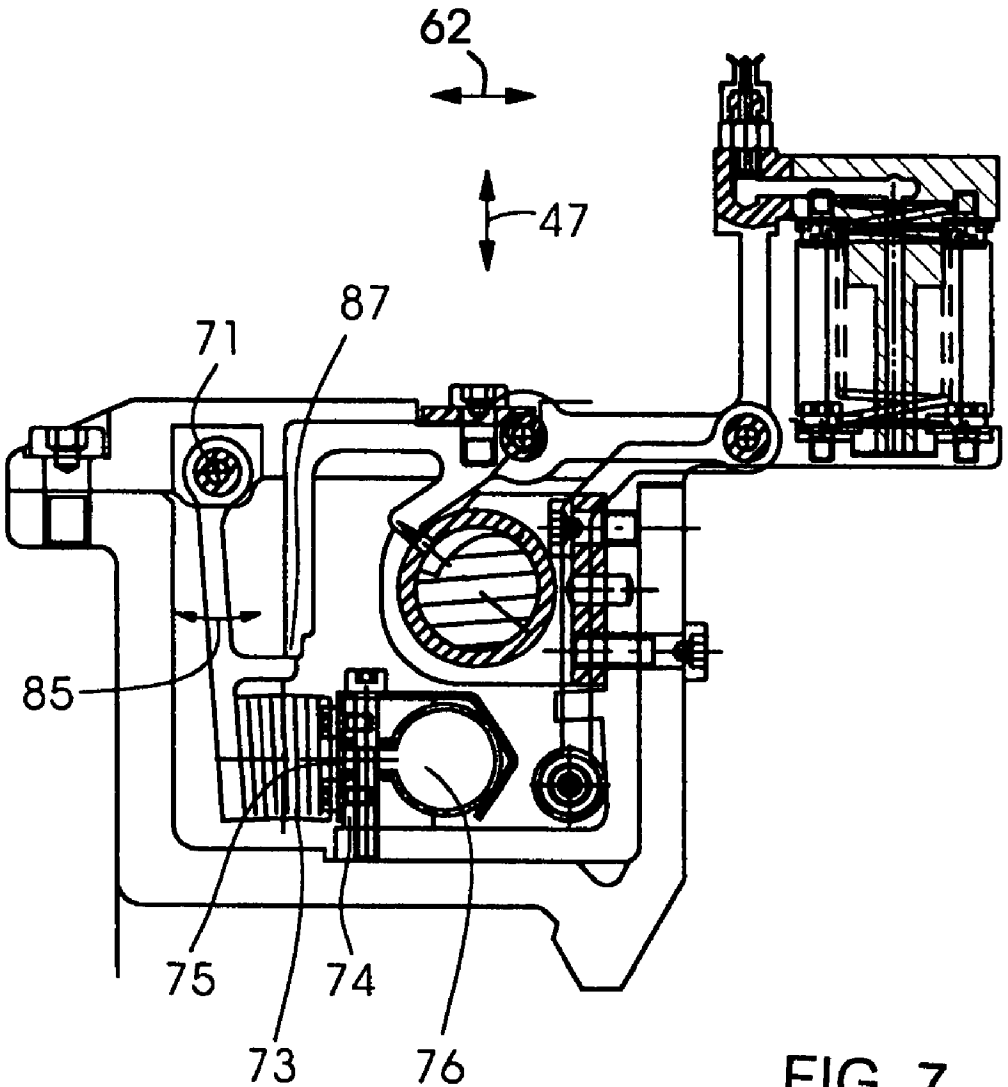
FIG. 7 shows blocking of suckers in the rest position.
Figure 8:
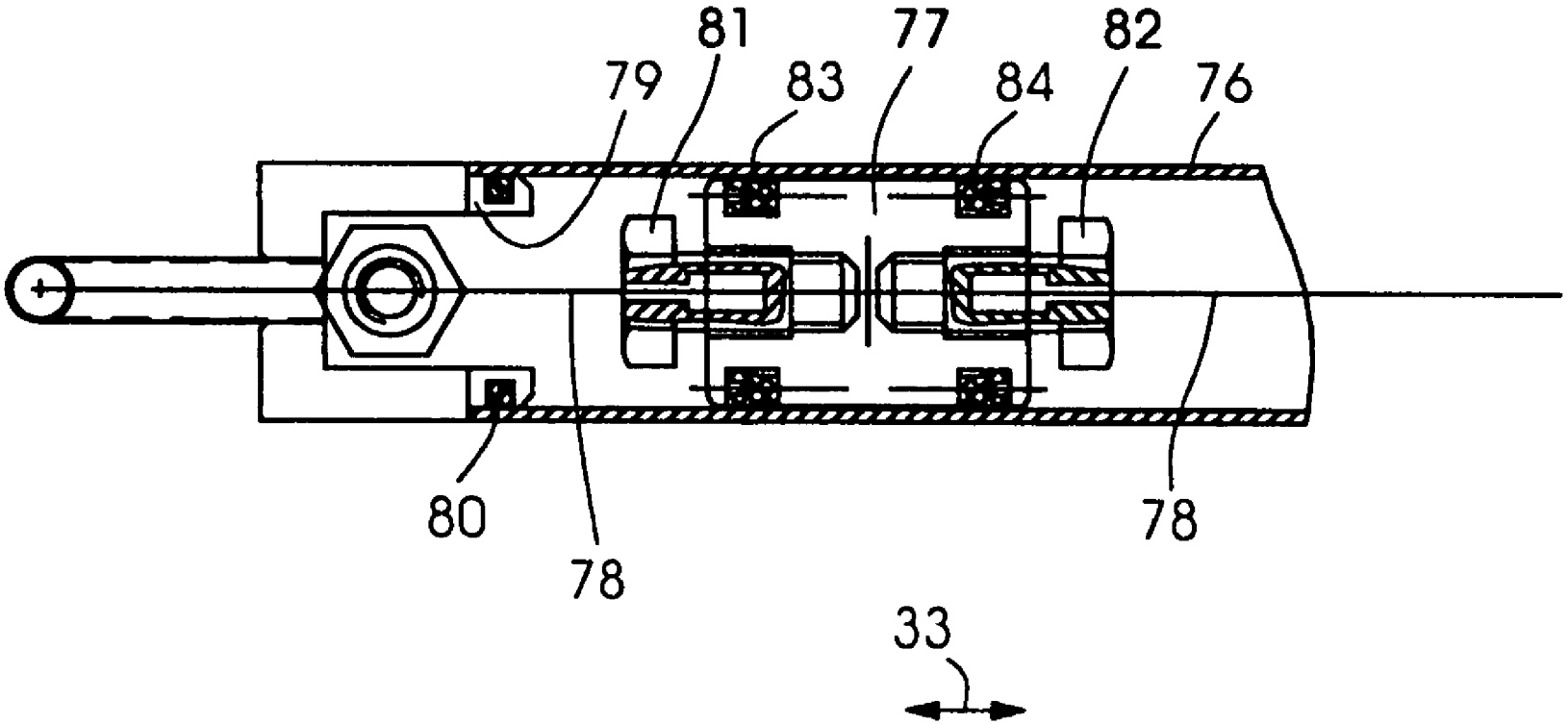
FIG. 8 shows a vacuum control system of a blocking lever having valve spools.

In FIG. 8, the pipe 76 is illustrated as a detail with one of the valve spools 77. The pipe 76 is closed at the side by covers 79 and seals 80. In the covers 79 there is a passage for the pull cable 78. The ends of the cables of the pull cables 78 are fixed to the valve spool 77 by screws 81, 82. There are sealing rings 83, 84 on the valve spool 77. In the pipe 76, the valve spools 77 delimit the space where is no vacuum applied. Depending on the position of the supporting elements 37 in the direction of the axis 33, the result is a position of the valve spools 77 in the pipe 76 such that the suckers 54 located between the valve spools 77 are in operation and all the others are switched off. If a sucker 54 is located in the region of the pipe 76 where vacuum prevails because of the position of the valve spool 77 then, as illustrated in FIG. 7, the bellows 73 is contracted by the vacuum. The blocking lever 72 completes a pivoting movement 85 about the axis 71. On the blocking lever 72 there is a stop lug 86 which, when the bellows 73 is contracted, prevents the end 87 of the lever 51, as illustrated in FIG. 4, being able to pivot in the radial direction 47 about the pin 50.

Therefore, the relevant suckers 54 remain in the rest position. If there is no vacuum on the bellows 73, then in each case the blocking lever 72 is located in the position shown in FIG. 4 as a result of the spring action of the bellows 73 and remains ineffective.

This application claims the priority, under 35 U.S.C. § 119, of German patent application No. 10 2004 042 257.5, filed Aug. 30, 2004; the entire disclosure of the prior application is herewith incorporated by reference.

We claim:

1. An apparatus for conveying a sheet through a printing machine, comprising:

a cylinder formed with a channel therein;

grippers disposed in said channel for holding the sheet at a leading edge thereof;

a delivery for forwarding the sheets, the delivery including:

circulating leading-edge grippers for holding and for transferring the sheet from said cylinder at the leading edge, and circulating, radially positionable, trailing edge suction grippers for holding the sheet at a trailing edge thereof;

an actuating apparatus for opening and closing said leading edge grippers and for controlling a vacuum for said trailing edge suction grippers;

a drive for said cylinder and said circulating leading-edge grippers and said trailing edge suction grippers;

a control device for selectively switching on and off a sheet feed to said cylinder;

a chain conveyor with endless chains having fixed thereto said leading-edge grippers;

rotating chain wheels carrying said endless chains;

coaxially circulating supporting elements for the sheet disposed between said chain wheels assigned to said cylinder, said supporting elements being in rolling contact with a peripheral surface of said cylinder and being movably mounted in a direction of an axis of rotation of said chain wheels in dependence on a sheet transverse format; and at least one valve spool connected to said supporting elements via a pull cable, for switching off respective said trailing edge suction grippers disposed laterally outside a given sheet width;

wherein said trailing edge suction grippers are mounted to be moved in a radial direction into a rest position when the sheet feed is switched off, said trailing edge suction grippers are moveable in the radial direction into a rest position in dependence on a sheet width of the sheet when the sheet feed is switched on, and said trailing edge suction grippers are movably disposed in the radial direction into the rest position as a result of an actuation of positioning elements for the axial displacement of said supporting elements.

2. The apparatus according to claim 1, wherein each respective said trailing edge suction gripper includes a valve nozzle, and said valve nozzle rests against a sealing surface in the rest position of said trailing edge suction gripper, to suppress a vacuum feed to said trailing edge suction gripper.

3. The apparatus according to claim 2, which comprises a bellows carrying the vacuum.

4. The apparatus according to claim 1, which comprises a cam shaft and plungers connected to said trailing edge suction grippers for moving said trailing edge suction grippers.

* * * * *